US009792842B2

(12) United States Patent
Carson

(10) Patent No.: US 9,792,842 B2
(45) Date of Patent: Oct. 17, 2017

(54) POST FLAG

(71) Applicant: John A. Carson, Ithaca, NY (US)

(72) Inventor: John A. Carson, Ithaca, NY (US)

( * ) Notice: Subject to any disclaimer, the term of this patent is extended or adjusted under 35 U.S.C. 154(b) by 126 days.

(21) Appl. No.: 14/598,361

(22) Filed: Jan. 16, 2015

(65) Prior Publication Data

US 2016/0210887 A1 Jul. 21, 2016

(51) Int. Cl.
*G09F 17/00* (2006.01)
*E04H 12/32* (2006.01)
*E04H 12/22* (2006.01)

(52) U.S. Cl.
CPC ..... *G09F 17/00* (2013.01); *E04H 12/2215* (2013.01); *E04H 12/32* (2013.01); *G09F 2017/0066* (2013.01)

(58) Field of Classification Search
CPC ... E04H 12/32; G09F 7/18; G09F 7/22; G09F 15/0056; G09F 15/0062; G09F 17/00; G09F 17/0066; G09F 2017/0066; G09F 2017/005
USPC ..... 116/173; 248/156, 530, 533, 545; 40/606.19, 607.03, 607.04, 607.05, 40/607.06, 607.08, 607.09, 610
See application file for complete search history.

(56) References Cited

U.S. PATENT DOCUMENTS 2,515,818 A * 7/1950 Bennett ..... G09F 7/00 40/607.06
4,249,715 A * 2/1981 Repp ..... E01F 9/685 248/156
4,378,650 A * 4/1983 Ottoson ..... E02D 5/80 40/607.06
4,843,746 A * 7/1989 DesNoyers et al. ..... G09F 7/18 248/156
4,866,866 A * 9/1989 Rotter ..... G09F 7/18 40/603
4,890,417 A * 1/1990 Futch ..... A01G 1/08 47/1.01 R
5,305,976 A * 4/1994 Blanchard ..... E04H 12/2215 248/156
D367,078 S * 2/1996 Oakley ..... D20/41
5,489,076 A * 2/1996 Thomas ..... G09F 7/20 248/150
5,502,910 A * 4/1996 Lucchesi ..... G09F 7/22 173/91

(Continued)

FOREIGN PATENT DOCUMENTS

DE 20216003 U1 * 12/2002 ..... E04H 12/32
WO WO 2010150184 A2 * 12/2010 ..... E04H 12/32

*Primary Examiner* — R. A. Smith
(74) *Attorney, Agent, or Firm* — Brown & Michaels, PC

(57) ABSTRACT

A post flag system includes a mounting tube and a flag. The mounting tube has a post section and a mounting section separated by a bend. The post section of the mounting tube goes over the upper end of a vertical post. The post section has an annular cross section of constant inner diameter greater than the outer dimension of the post to receive the upper end of the vertical post. The bend orients the mounting section at a mounting tube angle with respect to the post section. The flag has a surface displaying indicia and an edge coupled to the mounting section of the mounting tube. The mounting tube angle is preferably in the range of 90 to 100 degrees. A method of assembling a post flag system is also disclosed.

18 Claims, 4 Drawing Sheets

(56) References Cited

U.S. PATENT DOCUMENTS

| | | | | |
|---|---|---|---|---|
| 5,920,634 | A * | 7/1999 | Chiquette | G09F 7/22 381/124 |
| D434,082 | S * | 11/2000 | Tsiogas | D20/41 |
| 7,213,355 | B2 * | 5/2007 | Aires | G09F 17/00 40/604 |
| 7,318,266 | B2 * | 1/2008 | Bergh | A45F 3/44 248/156 |
| 7,325,344 | B2 * | 2/2008 | Eaton | E04H 12/2215 40/607.05 |
| 7,421,972 | B1 * | 9/2008 | Long | G09F 17/00 116/173 |
| D625,760 | S * | 10/2010 | Wormser | D20/21 |
| 8,857,632 | B2 * | 10/2014 | Anderson | A47F 7/22 211/105.1 |
| 9,390,640 | B1 * | 7/2016 | Coleman | E04H 12/2215 |
| 2002/0070321 | A1 * | 6/2002 | Womack | E04H 12/2215 248/156 |
| 2004/0206860 | A1 * | 10/2004 | Bolinder | E04H 12/2215 248/156 |
| 2005/0211857 | A1 * | 9/2005 | Bolinder et al. | E04H 12/2215 248/156 |
| 2006/0185203 | A1 * | 8/2006 | Bittle | G09F 7/20 40/541 |
| 2007/0068445 | A1 * | 3/2007 | Priegel | G09F 17/00 116/174 |
| 2009/0158631 | A1 * | 6/2009 | Christiansen et al. | G06Q 30/0256 40/607.04 |

* cited by examiner

POST FLAG

BACKGROUND OF THE INVENTION

Field of the Invention

The invention pertains to the fields of flag systems and flag supports. More particularly, the invention pertains to a post flag system for a vertical post and with a substantially horizontal section to attach to the flag.

Description of Related Art

Flag support posts are conventionally permanent structures dedicated to supporting a flag. Flag support posts are conventionally oriented vertically, with the flag being supported along its side. Since flags are conventionally made of a fabric or another flexible material, the flag merely hangs from the vertical pole in a heap in the absence of a strong wind, so that most of the flag surface is not visible.

SUMMARY OF THE INVENTION

A post flag system includes a mounting tube and a flag. The mounting tube includes a post section and a mounting section separated by a bend. The post section has an annular cross section of constant inner diameter greater than an outer dimension of a vertical post to receive the vertical post. The bend orients the mounting section at a mounting tube angle with respect to the post section. The flag includes a surface displaying indicia and having an edge coupled to the mounting section of the mounting tube. The mounting tube angle is in the range of 90 to 100 degrees. In some embodiments, the flag further comprises a sleeve along the edge of the flag sized to fit over the mounting section of the mounting tube. In some embodiments, the system further includes a clip having a first arm received in a mounting end of the mounting section of the mounting tube and a second arm flexibly connected to the first arm to extend along an outer surface of the mounting section to hold the edge of the flag against the mounting section.

A method of assembling a post flag system including a mounting tube and a flag includes attaching an edge of the flag to a mounting section of the mounting tube. The mounting tube includes a post section and the mounting section separated by a bend. The method also includes inserting an upper end of a vertical post into a post end of the post section of the mounting tube. The post section has an annular cross section of constant inner diameter greater than an outer dimension of the vertical post to receive the second end of the vertical post. The bend orients the mounting section at a mounting tube angle with respect to the post section. The post flag system is assembled such that the mounting section of the mounting tube is in a horizontal orientation.

DETAILED DESCRIPTION OF THE INVENTION

Figure 1:
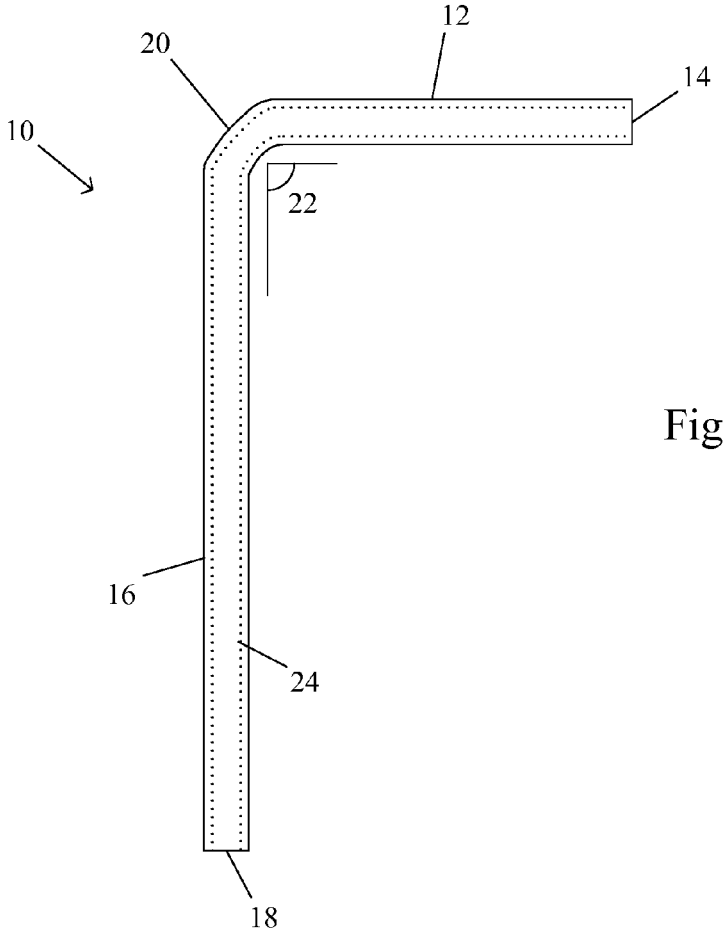
FIG. 1 shows a side view of a mounting tube of a post flag system in an embodiment of the present invention.

In a preferred embodiment, the post flag system includes a mounting tube and a flag. In some embodiments, the post flag system further includes a vertical post. In some embodiments, the post flag system further includes a clip.

The vertical post may be removably inserted into the ground or may be part of a moving structure or a structure more permanently mounted in the ground. Vertical posts include, but are not limited to, a fence post, a telephone pole, a car antenna, a golf hole flag post, and a snow pole. In some embodiments, the post flag system uses a vertical post conventionally used for another purpose and temporarily or permanently repurposes the vertical post as a support for the post flag system in order to display a flag at the site of the vertical post.

The vertical post preferably has a circular cross section of substantially constant diameter along most, if not all, of the length of the vertical post. The cross section of the vertical post, however, may have any shape within the spirit of the present invention, including, but not limited to, circular, square, rectangular, oval, triangular, or irregular, but preferably the maximum outer dimension of the cross section does not change significantly along the length of the vertical post at the top portion.

In embodiments with a removable vertical post, the first end of the vertical post is preferably inserted into the ground or a support opening on the ground and may taper toward the first end to allow easier insertion into the ground or the support opening. The second end of the vertical post may be any shape, including, but not limited to, flat or rounded. A removable vertical post is preferably made of fiberglass.

The mounting tube preferably has an annular cross section of constant inner and outer diameters along most of the length of the mounting tube. The mounting tube may be transparent, translucent, or opaque. In some embodiments, the mounting tube is transparent, so that certain features of or on the vertical post are still visible through the mounting tube. Preferred materials for the mounting tube include, but are not limited to, plastic, preferably acrylic, and metal, preferably copper or aluminum. The mounting tube preferably includes a bend between a post section and a mounting section of the mounting tube. In some embodiments, the bend is formed by bending an otherwise straight piece of tube. In some embodiments, the section of the tube to be bent is heated prior to bending, bent, and then allowed to cool once the bend is formed. The bend in the mounting tube prevents the mounting tube from completely sliding down the vertical post. The bend also permits a flag to be attached so that the flag hangs downward freely from the post without wrinkles in the flag verbiage.

The post section of the mounting tube slides over the vertical post by way of the opening in the post end. The inner diameter of the post section of the mounting tube is larger than the outer dimension of the vertical post. The inner diameter of the post section of the mounting tube is preferably about 10% to about 25% larger than the outer dimension of the vertical post. The flag is attached to the mounting section of the mounting tube.

The flag may be made of any conventional flag material, including, but not limited to, cloth, plastic, or metal. The flag material is preferably flexible. The flag preferably has a rectangular shape, although any shape that may be attached to the mounting end of the mounting tube may be used within the spirit of the present invention. The flag more preferably has a square shape or nearly square shape. In a preferred embodiment, the length of the flag and the width of the flag are within about 25% of each other.

The bend is preferably located about ⅗ to about ⅘ from the post end of the mounting tube. The bend is more preferably located about ⅔ to about ¾ of the way from the post end of the mounting tube. In some embodiments, the bend is located about ⅔ of the way from the post end of the mounting tube. In other embodiments, the bend is located about ¾ of the way from the post end of the mounting tube. The post section of the mounting tube is preferably longer than the mounting section of the mounting tube so that the mounting tube does not blow off the vertical post in high winds.

The mounting section of the mounting tube is preferably in a horizontal orientation in the assembled post flag system. A horizontal orientation, as used herein, is within five degrees of horizontal or level. The mounting section is preferably within three degrees of horizontal. The mounting section is more preferably within one degree of horizontal. In a preferred embodiment, the vertical post is mounted in the ground in a vertical orientation (90 degrees from horizontal) and the bend in the mounting tube is a 90-degree bend. In other embodiments, however, the vertical post may be mounted at an angle less than 90 degrees from a horizontal plane. In such embodiments, the angle between the mounting section and the post section is preferably greater than 90 degrees. The sum of the vertical post angle and the mounting tube angle is preferably 180 degrees so that the mounting tube is horizontal regardless of either individual angle measurement. The vertical post angle is preferably at least 80 degrees and the mounting tube angle is preferably in the range of 90 to 100 degrees. The vertical post angle is more preferably at least 85 degrees and the mounting tube angle is more preferably in the range of 90 to 95 degrees.

The flag preferably includes a design or indicia on at least one of the two sides of the flag. In some embodiments, the design or indicia is an advertisement. The flag may be of any dimensions, but the length of the flag is preferably less than the length of the post section of the mounting tube, so that the flag does not contact the ground in the post flag system. The width of the flag is preferably less than or equal to the length of the mounting section of the mounting tube.

The flag may be attached or coupled to the mounting section of the mounting tube in any of a number of different manners. In some embodiments, the flag includes a sleeve along one edge, where the sleeve is sized to slide over the outside of the mounting section. In other embodiments, an adhesive attaches the flag along one edge of the flag to the mounting section. The adhesive may be a strip of tape or may be applied directly to the edge of the flag or the mounting section. Alternatively, the adhesive may be a glue, preferably silicone. In other embodiments, a fastener attaches the flag to the mounting section. In some embodiments, the fastener is a clip that insert into the mounting end of the mounting tube and clips the flag to the mounting section. The clip may be attached to the flag or may merely press the flag against the mounting section to couple the flag to the mounting section. Other methods of attachment or securing the flag to the mounting section of the mounting tube include, but are not limited to, stapling, cementing, wrapping tightly, plastic welding, heat shrinking, screwing, and bolting.

Referring to FIG. 1, the mounting tube 10 includes a mounting section 12 separated from a post section 16 by a bend 20. The mounting tube has a mounting end 14 and a post end 18. The mounting section 12 is oriented at a mounting tube angle 22 with respect to the post section 16. An opening 24 extends through the mounting tube 10 from the post end 18 to the mounting end 14.

Figure 2:
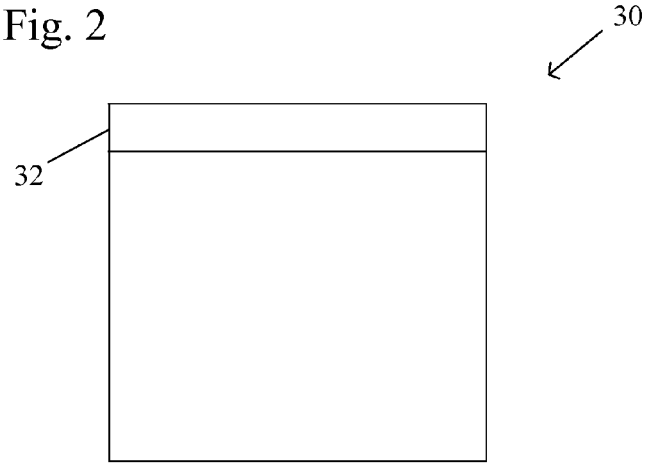
FIG. 2 shows a back view of a flag of a post flag system in an embodiment of the present invention.

Referring to FIG. 2, the flag 30 has a generally rectangular shape with a sleeve 32 along one edge of the rectangular shape.

Figure 3:
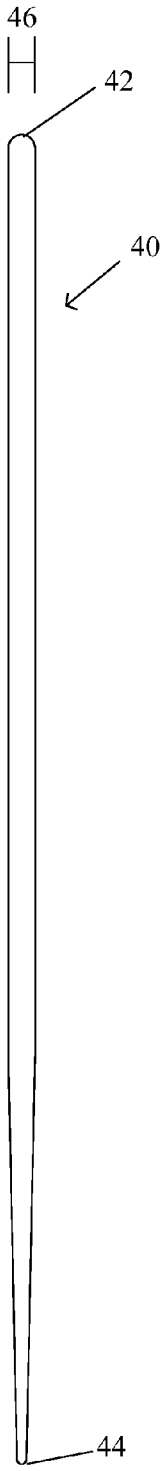
FIG. 3 shows a side view of a vertical post of a post flag system in an embodiment of the present invention.

Referring to FIG. 3, the vertical post 40 has a circular cross section and is substantially cylindrical through a central section of the vertical post 40. The first end 42 of the vertical post 40 is rounded. The second end 44 of the vertical post 40 is also rounded but tapered as well to allow it to be inserted more easily into hard ground. The vertical post has an outer dimension 46 to which the opening 24 of the mounting tube 10 is sized.

Figure 4:
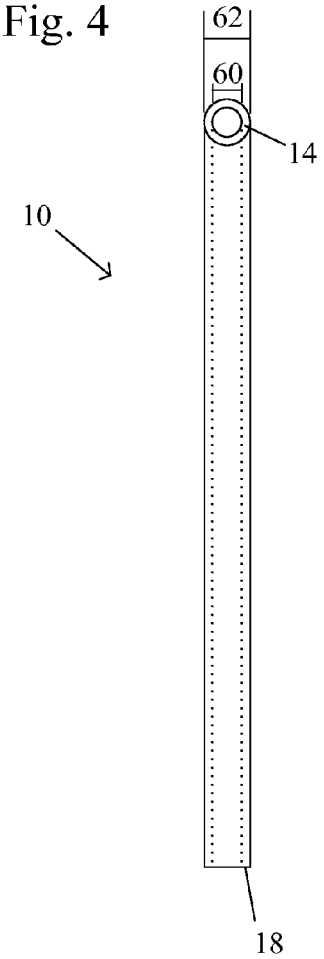
FIG. 4 shows a mounting end view of the mounting tube of FIG. 1.
Figure 5:
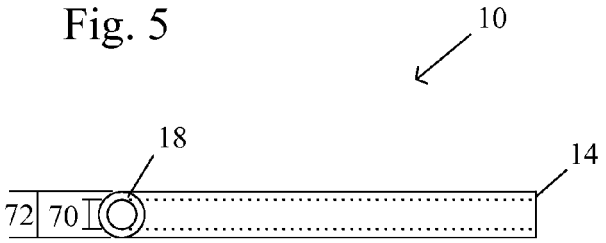
FIG. 5 shows a post end view of the mounting tube of FIG. 1.

FIG. 4 and FIG. 5 show the inner diameter 60, 70 and outer diameter 62, 72 of the mounting end 14 and the post end 18, respectively, of the mounting tube 10.

Figure 6:
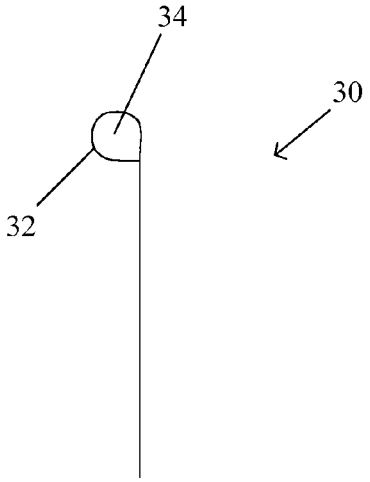
FIG. 6 shows a side view of the flag of FIG. 2.

FIG. 6 shows the opening 34 formed by the sleeve 32 of the flag 30 that is sized to receive the mounting section 12 of the mounting tube 10.

Figure 7:
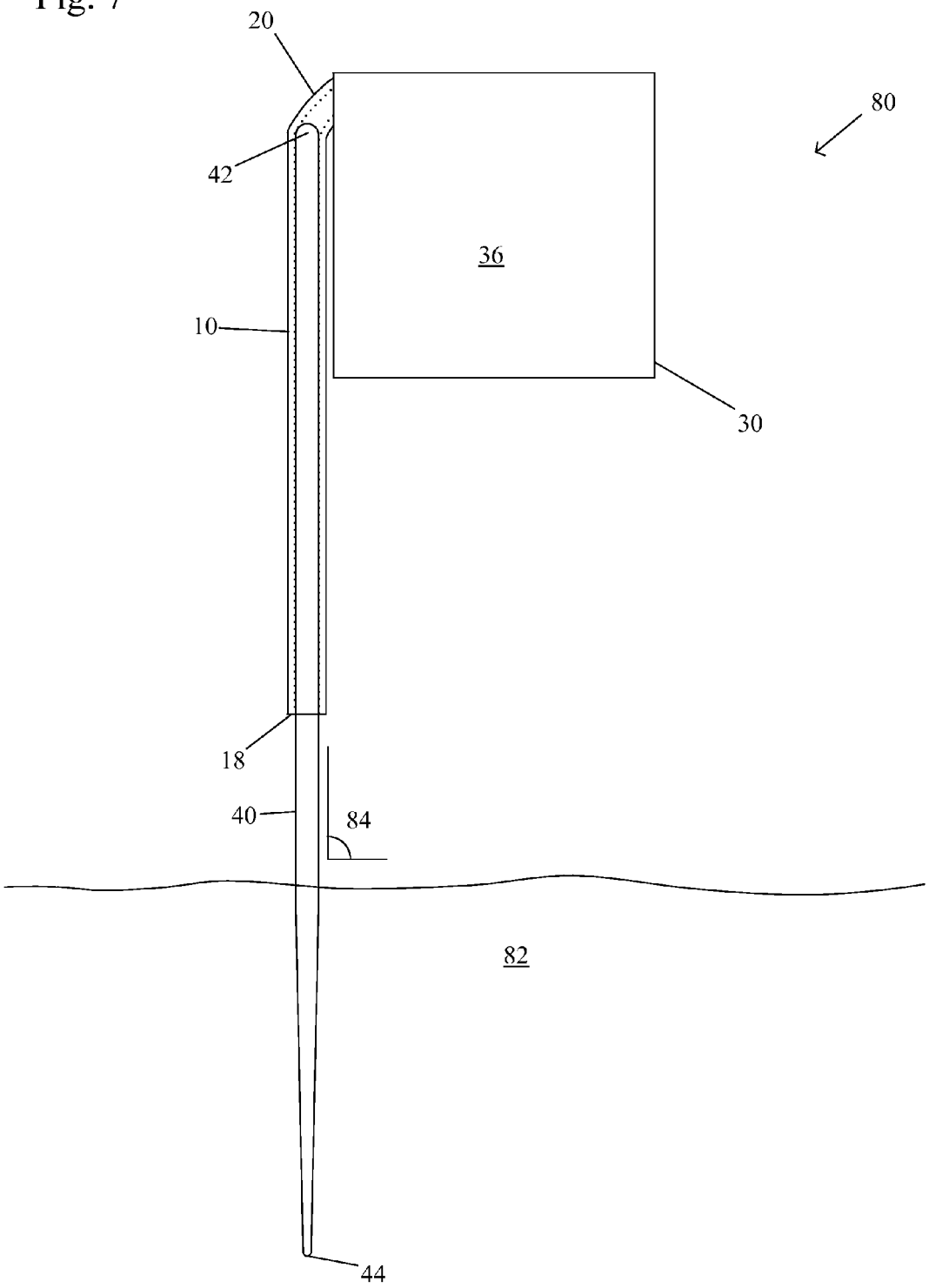
FIG. 7 shows a front view of a post flag system in an embodiment of the present invention.

Referring to FIG. 7, the post flag system 80 includes the mounting tube 10, the flag 30, and the vertical post 40. The vertical post 40 is mounted by inserting the second end 44 into the ground 82 at a vertical post angle 84. The post end 18 of the mounting tube 10 receives the first end 42 of the vertical post 40, which extends all the way into the post section of the mounting tube 10 until the first end 42 contacts the bend 20 in the mounting tube 10. The mounting section of the mounting tube 10 is inserted into the sleeve 32 (see FIG. 6) of the flag 30 to mount the flag 30 to the mounting tube 10. The front 36 of the flag 30 preferably includes a design or indicia to be displayed by the post flag system 80. The design or indicia may be for any purpose, including, but not limited to, advertising, ornamental appearance, or to display a message.

Figure 8:
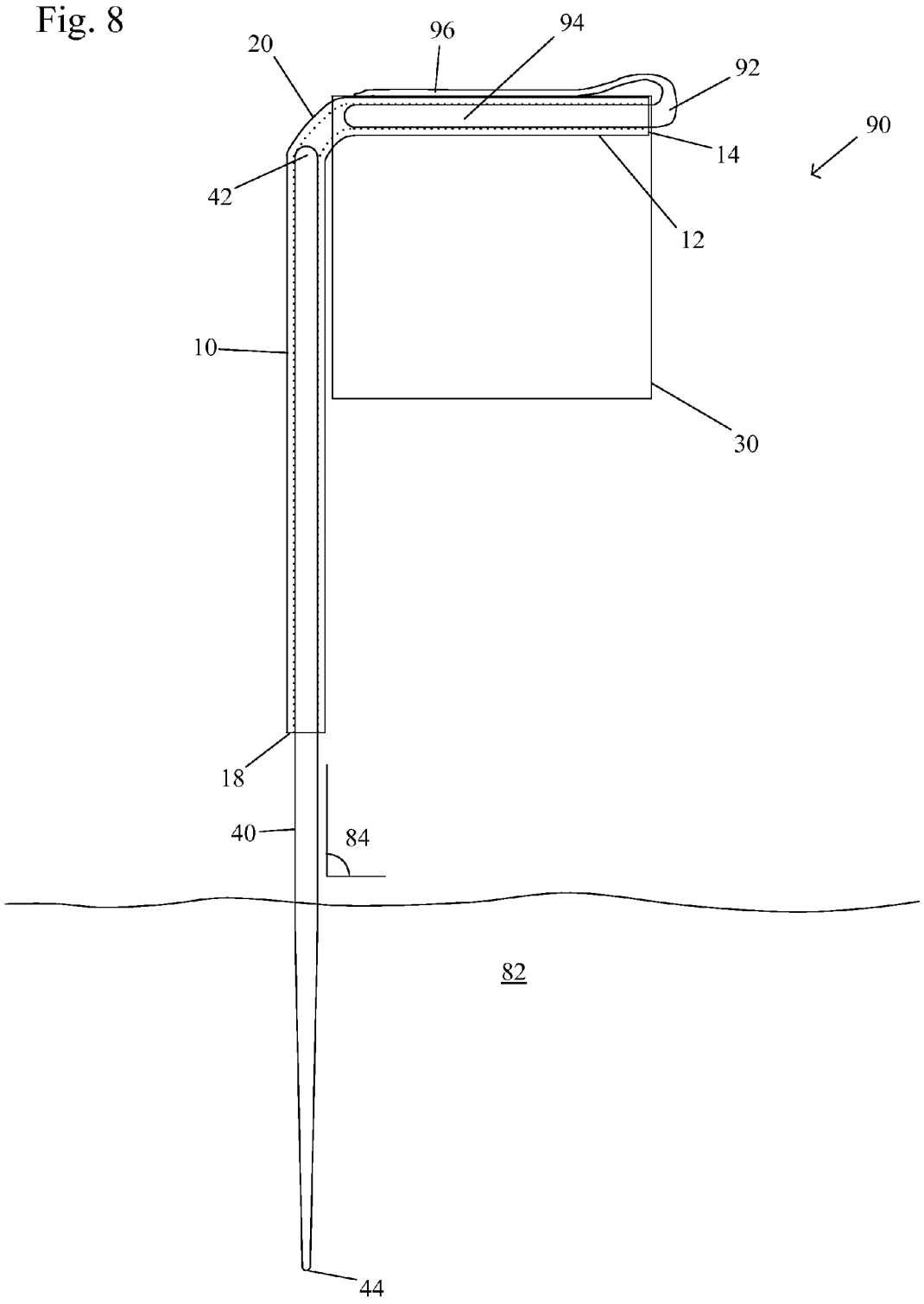
FIG. 8 shows a front view of a post flag system in an alternate embodiment of the present invention.

Referring to FIG. 8, the post flag system 90 includes the mounting tube 10, the flag 30, the vertical post 40, and a clip 92. The vertical post 40 is mounted by inserting the second end 44 into the ground 82 at a vertical post angle 84. The post end 18 of the mounting tube 10 receives the first end 42 of the vertical post 40, which extends all the way into the post section of the mounting tube 10 until the first end 42 contacts the bend 20 in the mounting tube 10. The mounting tube 10 and flag 30 are shown as transparent in FIG. 8 in order to show the clip 92 helping to maintain the flag 30 on the mounting section 12 of the mounting tube 10. One arm 94 of the clip 92 is inserted into the opening at the mounting end 14 of the mounting tube 10. The other arm 96 extends along the outer edge of the mounting section 12 and is slightly biased toward the first arm 94 to apply a force to the flag 30 to hold the flag 30 against the mounting section 12.

In some embodiments, the post flag system is only temporarily displayed at a particular location. In some embodiments, the post flag system is only temporarily displayed on a vertical post that otherwise serves another regular function. The post flag system may be easily assembled, disassembled, and re-assembled, so one or more of the components of the post flag system may be re-used as part of a post flag system displayed at a different location at a different time.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A post flag system comprising:

a mounting tube having a post section and a mounting section separated by a bend, wherein the post section has an annular cross section of constant inner diameter greater than an outer dimension of a vertical post to receive the vertical post and wherein the bend orients the mounting section at a mounting tube angle with respect to the post section;

a flag having a surface displaying indicia and having an edge coupled to the mounting section of the mounting tube; and a clip having a first arm received in a mounting end of the mounting section of the mounting tube and a second arm flexibly connected to the first arm to extend along an outer surface of the mounting section to hold the edge of the flag against the mounting section, wherein the mounting tube angle is in the range of 90 to 100 degrees.

2. The post flag system of claim 1 further comprising the vertical post having a first end, a second end opposite the first end, and a central section having a cross section with the outer dimension.

3. The post flag system of claim 2, wherein the annular cross section of constant inner diameter is in the range of 10% to 25% greater than the outer dimension.

4. The post flag system of claim 2, wherein the vertical post tapers toward the first end.

5. The post flag system of claim 2, wherein the vertical post is made of fiberglass.

6. The post flag system of claim 1, wherein the flag further comprises a sleeve along the edge of the flag sized to fit over the mounting section of the mounting tube.

7. The post flag system of claim 1, wherein the bend is located in the range of ⅗ to ⅘ of the way from a post end of the mounting tube to a mounting end of the mounting tube opposite the post end.

8. The post flag system of claim 7, wherein the bend is located ⅔ of the way from the post end of the mounting tube to the mounting end of the mounting tube.

9. The post flag system of claim 7, wherein the bend is located ¾ of the way from the post end of the mounting tube to the mounting end of the mounting tube.

10. A method of assembling a post flag system comprising a mounting tube and a flag, the method comprising the steps of:

a) attaching an edge of the flag to a mounting section of the mounting tube, the attaching step including: pushing a first arm of a clip away from a second arm of the clip, opposite the first arm; inserting the first arm into a mounting end of the mounting section of the mounting tube; and releasing the second arm of the clip to press toward an outer surface of the mounting section of the mounting tube; and b) inserting an upper end of a vertical post into a post end of the post section of the mounting tube, wherein the post section has an annular cross section of constant inner diameter greater than an outer dimension of the vertical post to receive the second end of the vertical post and wherein the bend orients the mounting section at a mounting tube angle with respect to the post section;

wherein the mounting tube has a post section, the mounting section is separated by a bend, and the post flag system is assembled such that the mounting section of the mounting tube is in a horizontal orientation.

11. The method of claim 10 further comprising inserting a lower end of the vertical post opposite the upper end into the ground.

12. The method of claim 10, wherein step a) comprises the sub-step of inserting the mounting section of the mounting tube into a sleeve located along the edge of the flag.

13. The method of claim 10, wherein the annular cross section of constant inner diameter is in the range of 10% to 25% greater than the outer dimension.

14. The method of claim 10, wherein the mounting tube angle is in the range of 90 to 100 degrees.

15. The method of claim 10, wherein the vertical post tapers toward the first end.

16. The method of claim 10, wherein the bend is located in the range of ⅗ to ⅘ of the way from the post end of the mounting tube to a mounting end of the mounting tube opposite the post end.

17. The method of claim 16, wherein the bend is located ⅔ of the way from the post end of the mounting tube to the mounting end of the mounting tube.

18. The method of claim 16, wherein the bend is located ¾ of the way from the post end of the mounting tube to the mounting end of the mounting tube.

* * * * *